US005590557A

United States Patent [19]

Keller et al.

[11] Patent Number: 5,590,557

[45] Date of Patent: Jan. 7, 1997

[54] ROLL STAND

[75] Inventors: Karl Keller, Hilchenbach; Konrad Hamraths, Kaarst; Erhard Afflerbach, Bad Laasphe; Dieter Klein, Siegen, all of Germany

[73] Assignee: SMS Schloemann-Siemag Aktiengesellschaft, Düsseldorf, Germany

[21] Appl. No.: 345,502

[22] Filed: Nov. 28, 1994

[30] Foreign Application Priority Data

Nov. 26, 1993 [DE] Germany ..... 43 40 313.1

[51] Int. Cl.[6] ..... B21B 31/10

[52] U.S. Cl. ..... 72/238; 72/248

[58] Field of Search ..... 72/237, 238, 239, 72/248

[56] References Cited

U.S. PATENT DOCUMENTS 3,712,102 1/1973 Eibe ..... 72/238
4,763,505 8/1988 Klute et al. ..... 72/238

FOREIGN PATENT DOCUMENTS 0281782 9/1988 European Pat. Off. .

*Primary Examiner*—W. Donald Bray
*Assistant Examiner*—Thomas C. Schoeffler
*Attorney, Agent, or Firm*—Friedrich Kueffner

[57] ABSTRACT

A roll stand for a pair of work rolls includes a housing with two side walls arranged on a common base plate. A cube-shaped receiving space which is open toward the top and toward two sides and is provided with guide surfaces for an insertable roll cassette is formed between the side walls. The insertable roll cassette of the roll stand includes two side plates which extend parallel to each other and are spaced at a distance from each other. The outer sides of the side plates are guided by the guide surfaces of the side walls. The side plates form guide means for two pairs of chocks which receive the work rolls with the bearings of the rolls. A pair each of interacting chocks are connected by means of adjusting spindles which absorb rolling forces, wherein the distance between chocks is adjustable so as to produce pre-adjustable passes. The adjusting spindles include adjusting collars and the side plates have adjusting pieces which are compatible with the adjusting collars. The adjusting collars and the adjusting pieces are in engagement with each other and serve to secure the spindles in axial direction to the roll center. The side plates are connected to each other by means of spacer members extending transversely of the side plates, so that a rigid cassette is formed by the spacer members and the side plates.

8 Claims, 3 Drawing Sheets

ROLL STAND

BACKGROUND OF THE INVENTION

1. Field of the Invention

The present invention relates to a roll stand for a pair of work rolls. The roll stand includes a housing with two side walls arranged on a common base plate. A cube-shaped receiving space which is open toward the top and toward two sides and is provided with guide surfaces for an insertable roll cassette is formed between the side walls.

2. Description of the Related Art

U.S. Pat. No. 4,763,505 discloses a roll stand with a roll changing unit which makes possible the mounting of rolls in different arrangements and dimensions and of different numbers of rolls. Pairs of horizontal support beams are inserted between vertical stand posts, wherein the support beams have guide grooves for horizontally insertable chocks which are engaged in a positively locking manner by the chocks with lateral slide elements which receive the roll bearings. For fitting the stand, for example, as a six-high stand, insertable intermediate support members are provided. This known roll stand is of relatively cumbersome and complicated construction.

EP-A-0 281 782 discloses a method of converting a roll stand from one type of roll stand to another type of roll stand with a different number of effective rolls, wherein, depending on the intended type of stand, the rolls are inserted as roll change units. In accordance with this method, the rolls are placed together with their chocks in guide members attached to the roll housing, wherein the rolls are inserted in a vertical arrangement between the back-up rolls in a positively locking manner and with the possibility of displacement along the roll axis, and wherein, for using the stand as a two-high stand, spacer members are placed between the chocks of the work rolls and the chocks of the back-up rolls.

SUMMARY OF THE INVENTION

Starting from the roll stands described above, it is the primary object of the present invention to provide a roll stand which is of simple construction and improves the output in practical use, wherein the difficulties of a simple solution are to be overcome without reducing the quality, and favorable conditions are to be realized for a quick roll change, particularly for a change of the complete cassette with pre-adjusted passes and fittings.

In accordance with the present invention, the insertable roll cassette of the roll stand includes two side plates which extend parallel to each other and are spaced at a distance from each other. The outer sides of the side plates are guided by the guide surfaces of the side walls. The side plates form guide means for two pairs of chocks which receive the work rolls with the bearings of the rolls. A pair each of interacting chocks are connected by means of adjusting spindles which absorb rolling forces, wherein the distance between chocks is adjustable so as to produce pre-adjustable passes. The adjusting spindles include adjusting collars and the side plates have adjusting pieces which are compatible with the adjusting collars. The adjusting collars and the adjusting pieces are in engagement with each other and serve to secure the spindles in axial direction to the roll center. The side plates are connected to each other by means of spacer members extending transversely of the side plates, so that a rigid cassette is formed by the spacer members and the side plates.

The configuration according to the present invention results in a cassette which can be pulled out of a roll stand, for example, by means of a crane. The cassette can then be moved as a uniform structural unit on a conventional travel path to an assembly site and back to the roll stand. For this purpose, travel rollers are mounted in the lower portion of the side plates. On the other hand, this configuration makes it possible to replace the cassette which has been taken out of the roll stand by another cassette whose passes and fittings have been preadjusted. This means that the pass adjustment in the roll stand is unnecessary, so that the roll exchange is extremely fast. The configuration proposed in accordance with the present invention is uncomplicated, requires comparatively few structural components and is not only suitable for an inexpensive manufacture, but also for a surprisingly fast roll change.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
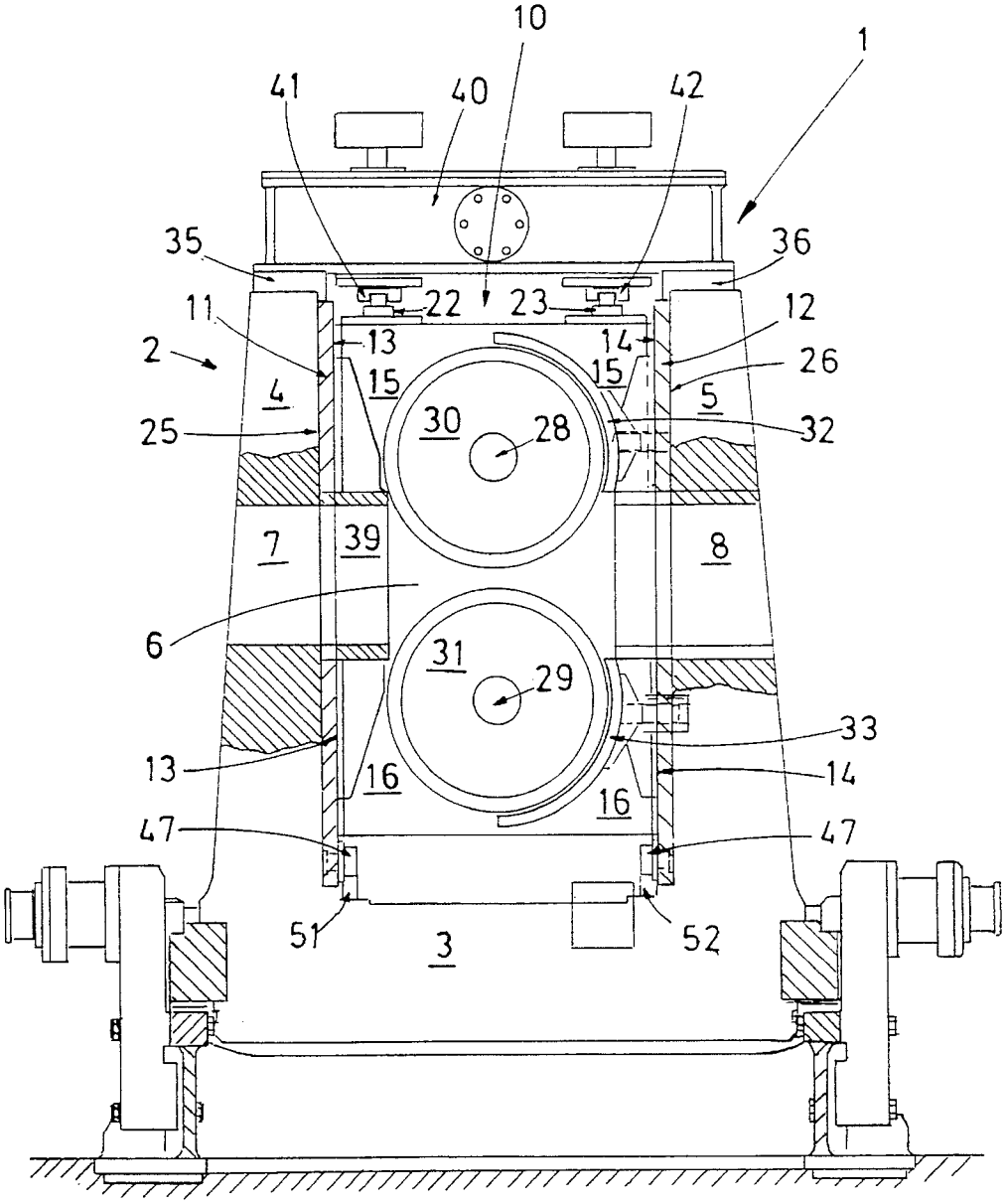
FIG. 1 is a side view, partially in section, of a roll stand according to the present invention, showing the end faces of the rolls, wherein the chocks on the viewing side are removed for clarity's sake.

The roll stand 1 illustrated in FIGS. 1 to 4 of the drawing includes a housing 2 with two side walls 4,5 mounted on a common base plate 3. A cube-shaped receiving space 6 which is open toward the top and toward two sides for an insertable roll cassette 10 is formed between the side walls 4, 5.

The roll cassette 10 has two side plates 11, 12 which extend parallel to each other and are spaced at a distance from each other. The outer sides of the sides of the side plates 11,12 are guided by the inner surfaces 25, 26 of the side walls 4,5. Guide means 13,14 for two pairs of chocks 15,16 are formed between the side plates 11,12. The chocks 15,16 receive the work rolls 30,31 and the bearings of the rolls. A pair each of interacting chocks 15,16 are connected by means of adjusting spindles 20,21 (shown in FIG. 4) which absorb rolling forces, wherein the distance between chocks is adjustable so as to produce preadjustable passes. The rolls 30,31 are supported at both ends thereof in the chocks 15,16. The chocks 15,16 are connected to the adjusting spindles 20,21 in a frictionally engaging manner. By means of the spindles 20,21, the chocks 15,16 with the rolls 30,31 are synchronously adjustable with respect to spacing and are secured or fixed to roll center.

In accordance with an embodiment of the present invention, the ends 22,23 of the spindles 20,21 which project upwardly beyond the upper chocks 15 are constructed as coupling claws. Mounted on the side walls 4,5 is a synchronous gear unit 40 which extends across the side walls 4,5 and is provided with four driven shafts 41,42, wherein the drive shafts of pairs of drive shafts rotate in opposite directions. The driven shafts 41, 42 are constructed as coupling heads for engaging the coupling claws of the spindle ends 22,23 in a positively engaging manner to ensure that the coupling claws rotate together with the coupling heads.

In accordance with an embodiment which is uncomplicated and easy to assemble, the side plates 11,12 are held and clamped to the housing 2 by means of releasable clamping elements 35,36, for example, clamping claws.

These clamping claws 35,36 can be tightened or released surprisingly easily, so that, after the fittings and clamping claws 35,36 have been released, the roll cassette 10 can be lifted as a self-contained structural unit out of the housing 2, for example, by means of a crane, or can be moved out to the side on rails provided for this purpose and by means of travel rollers 47. In the reverse sequence, a roll cassette 10 as a self-contained structural unit with preadjusted passes and with fittings can be placed into the roll stand 1 between the side walls 4,5 of the housing 2, for example, by means of a crane, or can be moved to or into the housing 2 by means of the travel rollers 47 at the side plates 11,12. This results in a cassette and roll exchange which can be carried out quickly.

In accordance with another development of the invention, the adjusting spindles 20,21 have adjusting collars 45 and the guide plates or side plates 11,12 have compatible adjusting pieces 46 which are in engagement with each other and serve to secure or fix the spindles 20,21 in axial direction to roll center.

Figures 2, 3:
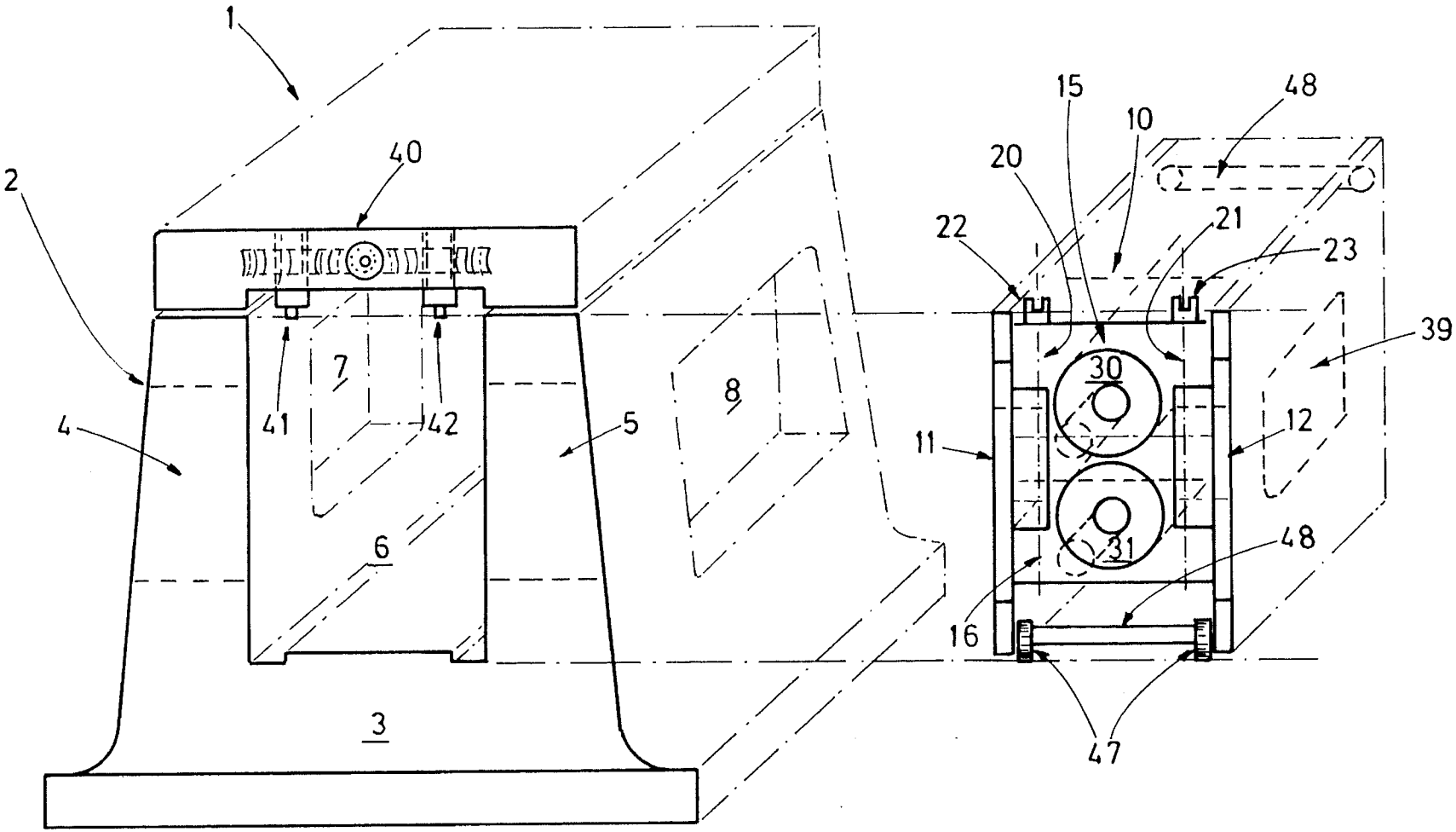
FIG. 2 is a partial perspective view of a stand housing.
FIG. 3 is a partial perspective view of a roll cassette.

These structural components are held together as a unit which can be manipulated by means of spacer members 48, shown in FIG. 3, which are arranged transversely of and connect the side plates 11,12 so as to form a rigid cassette 10.

Figure 4:
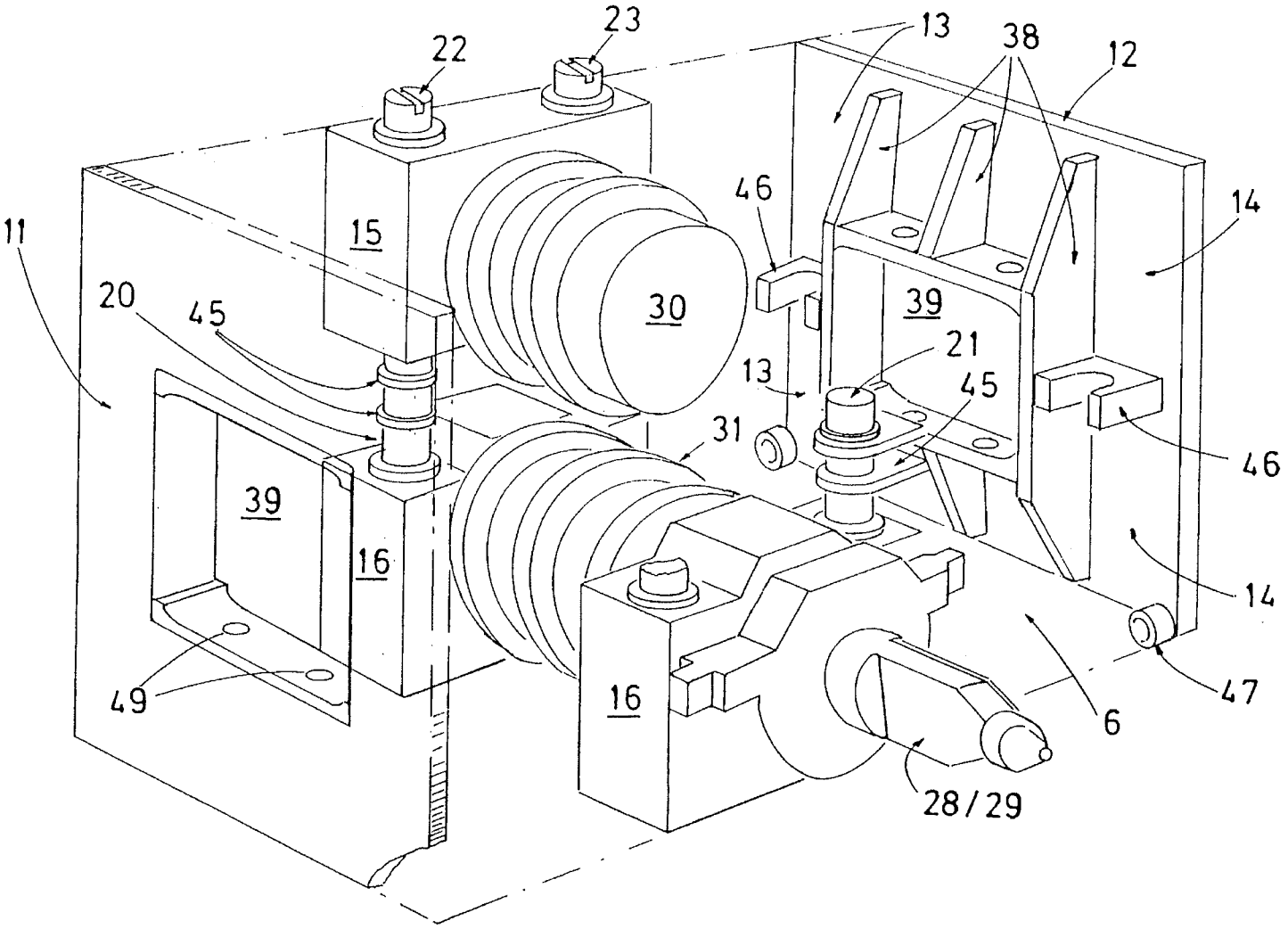
FIG. 4 is a perspective view of the roll cassette shown in the partially disassembled state.

As can be seen in FIG. 4, each side plate 11,12 has a window 39 to allow rolling stock to pass therethrough. The window 39 is surrounded by ribs 38. The side walls 4,5 of the housing 2 also have openings 7,8 which essentially coincide with the windows 39 of the side plates 11,12.

At least the horizontal ribs of the window 39 of each side plate 11,12 are provided with bores 49 which make it possible to mount rolling stock guide means which can be preassembled. This provides the advantage that rolling stock guide means can be divided into those which are mounted in the plate opening as high-wear components in a stand-by arrangement, and those which can remain for a longer period of time in the rolling mill train, such as, guide funnels and the like. For this purpose, the side walls 4,5 of the housing 2 may also have in the area of the openings 7,8 support members, for example, for mounting the guide funnels.

An important feature of the construction according to the present invention is the fact that the side plates 11, 12 of the roll cassette 10 extend parallel to the axis x—x of the rolls 30, 31. This results in a surprisingly uncomplicated and simple construction of the roll cassette 10.

The roll stand 1 according to the present invention has the additional advantage that the exchangeable unit, i.e., the complete cassette 10 has a relatively low weight and can be moved more easily as a result.

Because of the advantages mentioned above, the roll change in the roll stand 1 is without problems. For this purpose, the connections for media supplies for the cassette 10 are disconnected and the rolls 30,31 are then moved into the end position. Subsequently, the connecting elements between the synchronous gear unit 40 and the side walls 4,5 are released and the synchronous gear unit 40 is lifted off and put aside. Subsequently, the clamping claws 35,36 which hold the side plates 11, 12 at the side walls 4,5, are also released and the cassette 10 which contains the set of rolls is moved, for example, with its rollers 47 on rails 51,52 of the stand 1 out to the side, wherein the roll shafts 28,29 are separated from the drive heads which engage over the drive shafts for the drive connection. The cassette 10 can also be lifted, for example, by means of a crane, toward the top and out of the roll stand 1 and can be transported to an assembly site, where a roll change can be carried out in the known manner by using assembly carriages. In exchange for the removed roll cassette 10, another prepared roll cassette 10 can now be moved from the assembly site to the roll stand and can be inserted into the roll stand 1 from the top or from the side, wherein, in the reverse sequence, initially a connection between the shaft ends 28,29 of the work rolls 30,31 and the drive heads is effected, the synchronous gear unit 40 is subsequently placed and fastened on the side walls 4,5 and the side plates 11,12 are clamped in the roll stand by means of the clamping elements 35, 36. The connections for media supplies are then reconnected. The roll gap has already been preadjusted at the assembly site by means of the adjusting spindles 21,22, so that the roll gap does not have to be adjusted in the roll stand. Consequently, an exchange of a roll cassette 10 in the roll stand 1 can be carried out in a surprisingly short time, while the roll exchange which takes a significantly longer time can be carried out at the assembly site within the removed cassette 10 without hindering the production of rolling stock.

The roll stand according to the present invention is uncomplicated and overcomes the difficulties of a simple construction and of a quick roll change with preadjusted passes without reducing the quality and with surprisingly economical means.

The invention is not limited by the embodiments described above which are presented as examples only but can be modified in various ways within the scope of protection defined by the appended patent claims.

I claim:

1. In a roll stand for a pair of work rolls, the roll stand comprising a base plate, a housing with two side walls mounted on the base plate, the housing having a top, the side walls having guide surfaces and defining therebetween a cube-shaped receiving space which is open toward the top and toward two sides for an insertable roll cassette, the work rolls having axes, the roll cassette comprising two side plates which extend parallel to each other and are spaced at a distance from the roll axes, the side plates having outer sides, the outer sides of the side plates being guided by the guide surfaces of the side walls, the side plates comprising guide means for two pairs of chocks for receiving the work rolls and bearings of the rolls, the improvement comprising pairs of adjusting spindles which absorb rolling forces for connecting a pair each of interacting chocks, wherein a distance between chocks is adjustable so as to produce preadjustable passes, the adjusting spindles comprising adjusting collars and the side plates having adjusting pieces compatible with the adjusting collars, the adjusting collars and the adjusting pieces being in engagement with each other and serving to secure the adjusting spindles in axial direction to a roll center, and spacer members extending transversely of the side plates for connecting the side plates to each other, such that a rigid cassette is formed by the spacer members and the side plates, wherein the adjusting spindles have upper ends projecting above upper chocks, the upper ends comprising coupling claws, a synchronous gear unit being mounted on and bridging over the side walls, the synchronous gear unit comprising four driven shafts which and are arranged in pairs, wherein the shafts of each pair rotate in opposite directions, the driven shafts comprising coupling heads for a positively locking engagement in the coupling claws of the upper ends of the adjusting spindles, and wherein the side walls have at openings thereof means for mounting preassembleable elements.

2. The roll stand according to claim 1, comprising releasable clamping elements for clamping the side plates to the housing.

3. The roll stand according to claim 2, wherein the releasable clamping elements are clamping claws.

4. The roll stand according to claim 1, wherein the side plates have lower ends, the roll stand comprising travel rollers at the lower ends of the side plates, such that the insertable roll cassette can be moved into and out of the receiving space on the travel rollers.

5. The roll stand according to claim 1, wherein each side plate has a window surrounded by ribs for allowing rolling stock to pass therethrough.

6. The roll stand according to claim 5, wherein each window comprises a horizontal rib, at least the horizontal ribs of the windows having bores for mounting preassemblable rolling stock guide means.

7. The roll stand according to claim 6, wherein the openings essentially are in alignment with the windows of the side plates.

8. The roll stand according to claim 7, wherein the preassemblable elements are guide funnels.

* * * * *